US010302364B2

(12) United States Patent
Esformes et al.

(10) Patent No.: US 10,302,364 B2
(45) Date of Patent: May 28, 2019

(54) INTEGRATED SEPARATOR-DISTRIBUTOR FOR FALLING FILM EVAPORATOR

(71) Applicant: Carrier Corporation, Farmington, CT (US)

(72) Inventors: Jack Leon Esformes, Jamesville, NY (US); Ricardo Munoz, South Windsor, CT (US)

(73) Assignee: CARRIER CORPORATION, Farmington, CT (US)

( * ) Notice: Subject to any disclaimer, the term of this patent is extended or adjusted under 35 U.S.C. 154(b) by 381 days.

(21) Appl. No.: 14/913,897

(22) PCT Filed: Jun. 30, 2014

(86) PCT No.: PCT/US2014/044785

§ 371 (c)(1),
(2) Date: Feb. 23, 2016

(87) PCT Pub. No.: WO2015/034573

PCT Pub. Date: Mar. 12, 2015

(65) Prior Publication Data

US 2016/0201991 A1 Jul. 14, 2016

Related U.S. Application Data

(60) Provisional application No. 61/874,614, filed on Sep. 6, 2013.

(51) Int. Cl.
*F28D 3/02* (2006.01)
*F28D 3/04* (2006.01)
(Continued)

(52) U.S. Cl.
CPC ..... *F28D 3/02* (2013.01); *F24F 1/0059* (2013.01); *F25B 39/028* (2013.01); *F28D 3/04* (2013.01)

(58) Field of Classification Search
CPC .. F28D 3/02; F28D 3/04; F24F 1/0059; F25B 39/028; F25B 2339/042
See application file for complete search history.

(56) References Cited

U.S. PATENT DOCUMENTS 5,561,987 A * 10/1996 Hartfield ..... B01D 1/04 165/117
5,645,124 A 7/1997 Hartfield et al.
(Continued)

FOREIGN PATENT DOCUMENTS

CN 1185202 A 6/1998
CN 101191683 A 6/2008
(Continued)

OTHER PUBLICATIONS

Notification of Transmittal of the International Search Report and the Written Opinion of the International Searching Authority, or the Declaration; Application No. PCT/US2014/044785; dated Oct. 29, 2014; 9 pages.
(Continued)

*Primary Examiner* — Elizabeth J Martin
(74) *Attorney, Agent, or Firm* — Cantor Colburn LLP

(57) ABSTRACT

A falling film evaporator includes a plurality of evaporator tubes through which a volume of thermal energy transfer medium is flowed and a separator to separate a flow of liquid refrigerant from a vapor and liquid refrigerant mixture. A distributor distributes a flow of liquid refrigerant over the plurality of evaporator tubes. One or more vents stacks direct a flow of vapor refrigerant from the separator to a vent stack outlet in proximity to a refrigerant pool of the evaporator.

18 Claims, 5 Drawing Sheets

(51) Int. Cl.
*F25B 39/02* (2006.01)
*F24F 1/0059* (2019.01)

(56) References Cited

U.S. PATENT DOCUMENTS

| | | | | |
|---|---|---|---|---|
| 6,868,695 | B1 * | 3/2005 | Dingel | F25B 39/028 165/115 |
| 2010/0242533 | A1 * | 9/2010 | De Larminat | F25B 39/028 62/498 |

FOREIGN PATENT DOCUMENTS

| | | | |
|---|---|---|---|
| CN | 101932893 | A | 12/2010 |
| JP | 3138438 | B2 | 2/2001 |

OTHER PUBLICATIONS

Chinese Office Action Issued in on Application No. 201480048901.6, dated May 25, 2015, 8 pages.

* cited by examiner

INTEGRATED SEPARATOR-DISTRIBUTOR FOR FALLING FILM EVAPORATOR

BACKGROUND

The subject matter disclosed herein relates to heating, ventilation and air conditioning (HVAC) systems. More specifically, the subject matter disclosed herein relates to falling film evaporators for HVAC systems.

HVAC systems, such as chillers, use an evaporator to facilitate a thermal energy exchange between a refrigerant in the evaporator and a medium flowing in a number of evaporator tubes positioned in the evaporator. In a flooded evaporator, the tubes are submerged in a pool of refrigerant. This results in a particularly high volume of refrigerant necessary, depending on a quantity and size of evaporator tubes, for efficient system operation. Another type of evaporator used in chiller systems is a falling film evaporator. In a falling film evaporator, the evaporator tubes are positioned typically below a distribution manifold from which refrigerant is urged, forming a "falling film" on the evaporator tubes.

Falling film evaporators commonly employ a distribution system whose function is to convey liquid refrigerant equitably over the falling film tube bundle. The uniformity of liquid refrigerant supplied to the falling film bundle is critical to the performance of a falling film evaporator. One of the more effective approaches uses a separator to separate liquid refrigerant from the liquid-vapor refrigerant mixture that enters the separator. The liquid refrigerant is then drained from the separator and conveyed to a distribution manifold that meters the flow of liquid refrigerant equitably over the evaporator tubes. The separator may be located externally or internally to the evaporator however it is commonly the latter due to the added cost and complexity of the former by way of external piping, packaging and the requirement for the separator to meet pressure vessel certification standards, for example ASME VIII.

BRIEF SUMMARY

In one embodiment, a heating, ventilation and air conditioning (HVAC) system includes a compressor flowing a flow of refrigerant therethrough and a falling film evaporator in flow communication with the compressor. The falling film evaporator includes a plurality of evaporator tubes through which a volume of thermal energy transfer medium is flowed and a separator to separate a flow of liquid refrigerant from a vapor and liquid refrigerant mixture. A distributor distributes a flow of liquid refrigerant over the plurality of evaporator tubes. One or more vents stacks direct a flow of vapor or mostly vapor refrigerant from the separator into the vicinity of a refrigerant pool of the evaporator.

In another embodiment, a falling film evaporator includes a plurality of evaporator tubes through which a volume of thermal energy transfer medium is flowed and a separator to separate a flow of liquid refrigerant from a vapor and liquid refrigerant mixture. A distributor distributes a flow of liquid refrigerant over the plurality of evaporator tubes. One or more vents stacks direct a flow of vapor or mostly vapor refrigerant from the separator into the vicinity of a refrigerant pool of the evaporator.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
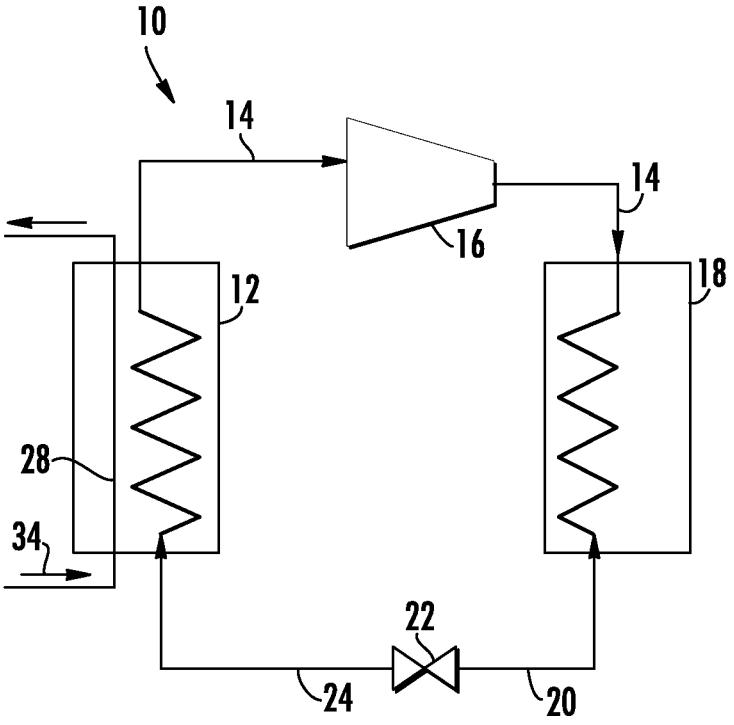
FIG. 1 is a schematic view of an embodiment of a heating, ventilation and air conditioning system.

The detailed description explains embodiments of the invention, together with advantages and features, by way of example with reference to the drawing.

DETAILED DESCRIPTION

Shown in FIG. 1 is a schematic view an embodiment of a heating, ventilation and air conditioning (HVAC) unit, for example, a chiller 10 utilizing a falling film evaporator 12. A flow of vapor refrigerant 14 is directed into a compressor 16 and then to a condenser 18 that outputs a flow of liquid refrigerant 20 to an expansion valve 22. The expansion valve 22 outputs a vapor and liquid refrigerant mixture 24 toward the evaporator 12.

Figure 2:
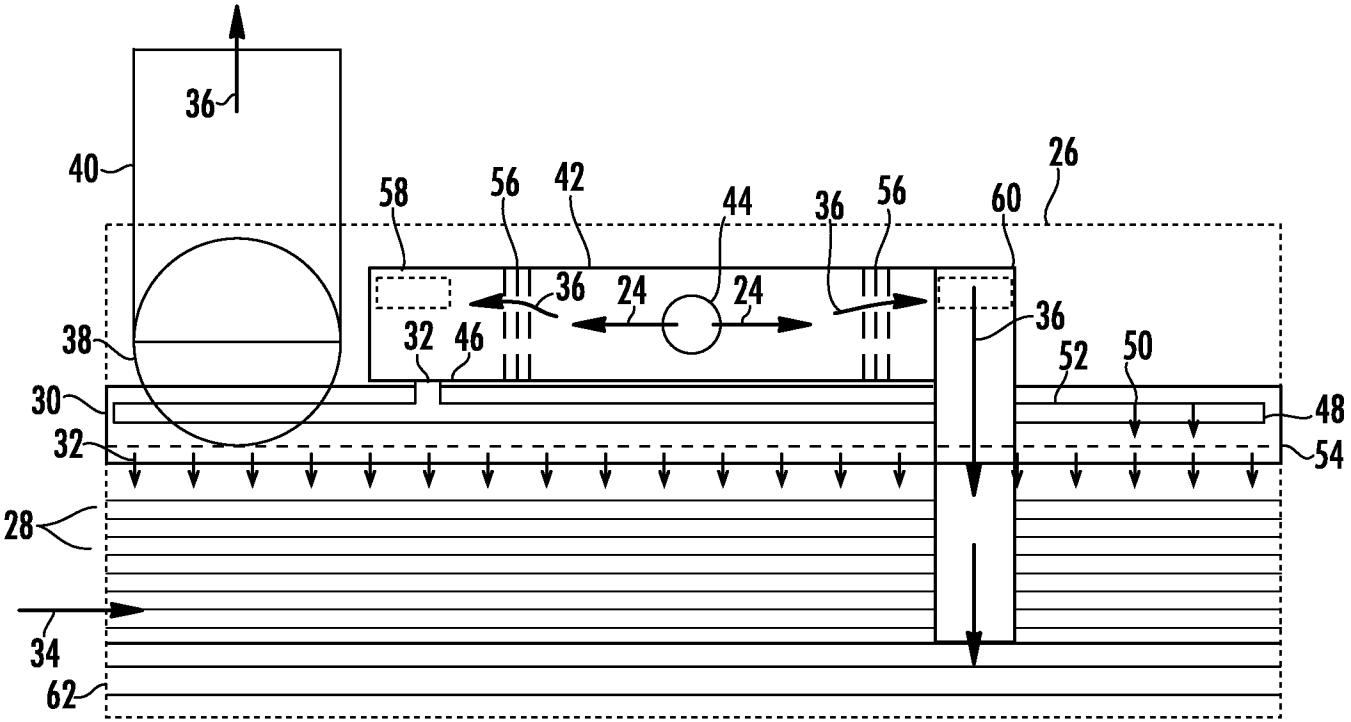
FIG. 2 is a schematic view of an embodiment of a falling film evaporator.

Referring now to FIG. 2, as stated above, the evaporator 12 is a falling film evaporator. The evaporator 12 includes housing 26 with the evaporator 12 components disposed at least partially therein, including a plurality of evaporator tubes 28. A distributor 30 is located above the evaporator tubes 28 to distribute liquid refrigerant 32 over the evaporator tubes 28. A thermal energy exchange occurs between a flow of heat transfer medium 34 flowing through the evaporator tubes 28 into and out of the evaporator 12 and the liquid refrigerant 32. As the liquid refrigerant 32 is boiled off in the evaporator 12, the resulting vapor refrigerant 36 is directed to the compressor 16 via a suction nozzle 38 and through a suction line 40.

A separator 42 is located in the housing 26 upstream of the distributor 30. In some embodiments, the separator 42 abuts the distributor 30, sharing a common wall. The separator 42 includes a refrigerant inlet 44 for vapor and liquid refrigerant mixture 24 to enter the separator 42. In some embodiments, the refrigerant inlet 44 is disposed at a lateral center of the separator 42. The separator 42 utilizes gravity to separate the liquid refrigerant 32 from the vapor and liquid refrigerant mixture 24, resulting in a volume of vapor refrigerant 36 in the separator 42. In some embodiments, the separator 42 also utilizes a mechanical eliminator 56 to further enhance liquid-vapor separation. Liquid refrigerant 32 leaves the separator 42 and enters the distributor 30 via one or more drains 46.

The liquid refrigerant 32 enters the sparge channel 48 via drains 46 in the separator 42. The sparge channel 48 may be a pipe having a circular cross-section, or may have other cross-sectional shapes, such as curvilinear, oval, triangular, rectangular or the like. Sparge channel openings 50 arranged on an upper portion 52 of the sparge channel 48 allow flow of the liquid refrigerant 32 out of the sparge channel 48, into the distributor chamber 30, and through a distribution sheet 54 forming a falling film over the evaporator tubes 28.

Figure 3:
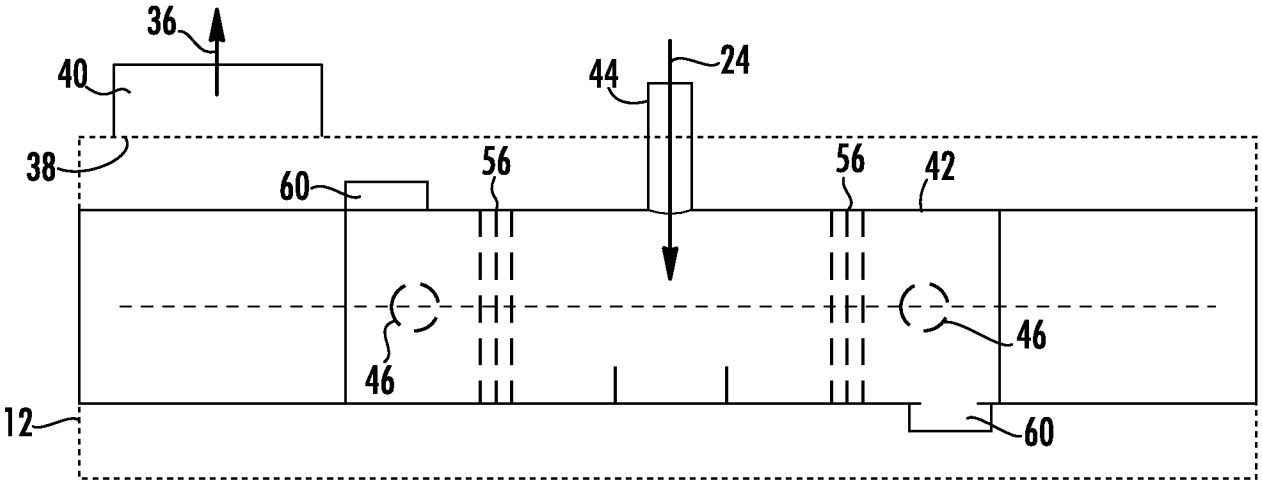
FIG. 3 is a top view of an embodiment of a falling film evaporator.

The vapor refrigerant 36 flows through the mechanical eliminator 56 if needed, which is, in some embodiments, one or more perforated plates or one or more mesh screens, toward a separator outlet 58. The mechanical eliminator 56 captures additional liquid refrigerant 32 entrained in the vapor refrigerant 36. Once through the separator outlet 58, the vapor refrigerant 36 and remainder of entrained liquid refrigerant 32 flows through a vent stack 60 downwardly into the evaporator 12, specifically with its' outlet in proximity with a refrigerant pool 62 at a bottom of the evaporator 12. The entrained liquid refrigerant in the vapor refrigerant 36 exiting the vent stack is captured in the refrigerant pool 62 thus allowing only vapor refrigerant 36 to return to the compressor 16 via the suction nozzle 38 and through the suction line 40. In the embodiments shown in FIG. 2 and FIG. 3, two vent stacks 60 are positioned symmetrically with respect to the refrigerant inlet 44 of the separator 42, however, as few as one or more than two vent stacks 60 may be used. The vent stack 60 and its' outlet in proximity with the refrigerant pool 62 is a key feature of the present disclosure as it permits the use of a highly compact separator 42 thereby facilitating its' cost effective integration within the evaporator 12.

Figure 4:
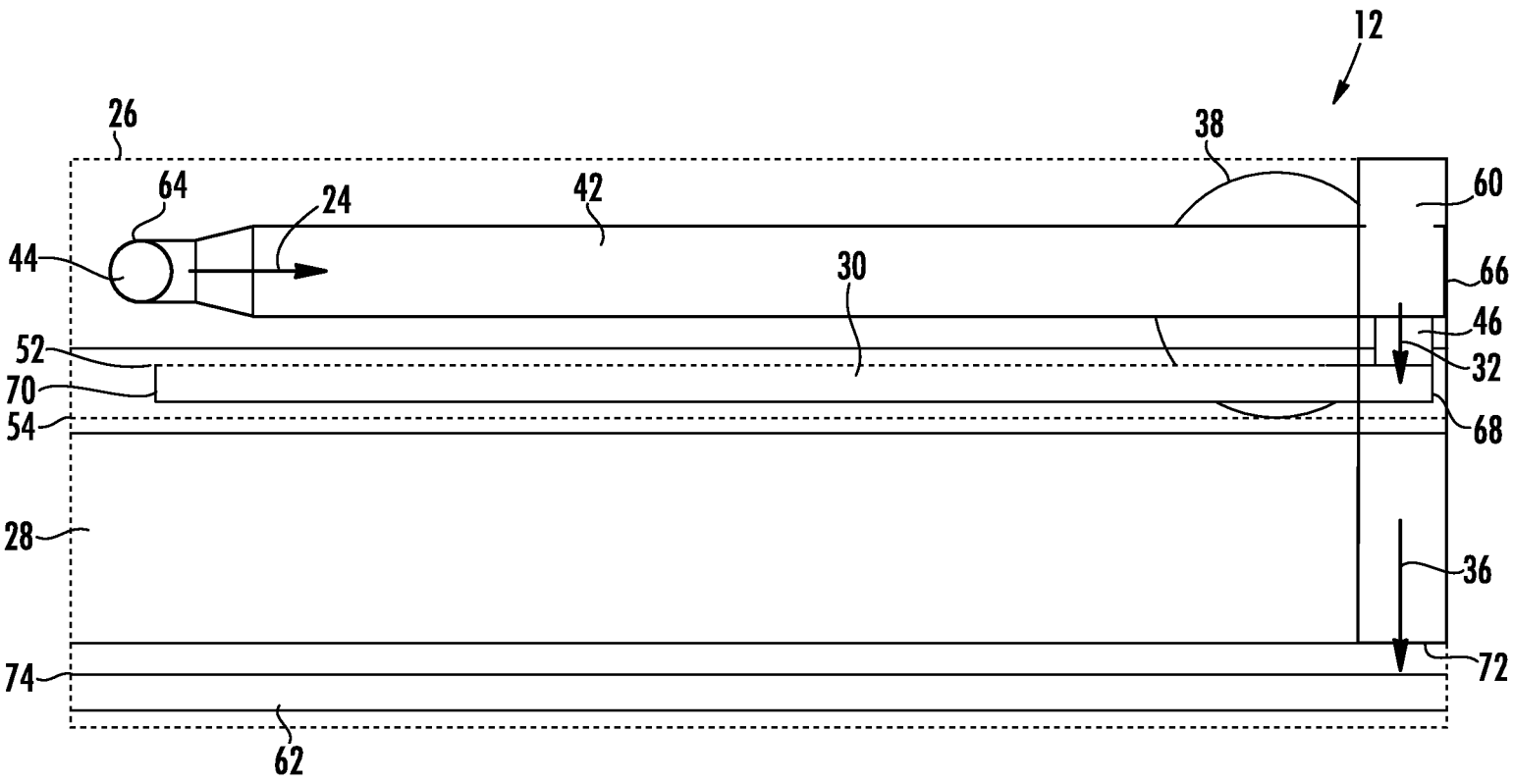
FIG. 4 is a cross-sectional view of another embodiment of a falling film evaporator.

Another embodiment of evaporator 12 is illustrated in FIG. 4. In this embodiment, the separator 42 is located in the housing 26, with the refrigerant inlet 44 at a first end 64 of the separator 42 and the drain 46 at a second end 66 of the separator 42, opposite the first end 64. As the vapor and liquid refrigerant mixture 24 travels along the length of the separator 42, liquid refrigerant 32 is separated from the vapor and liquid refrigerant mixture 24 and flowed into the distributor 30 through the drain 46. As in the previous described embodiment, this embodiment includes a vent stack 60 that conveys the refrigerant vapor 36 to the vicinity of the refrigerant pool 62, may use a separator 42 that shares a common wall with the distributor 30 or is separate, and may use mechanical eliminators 56.

Figure 5:
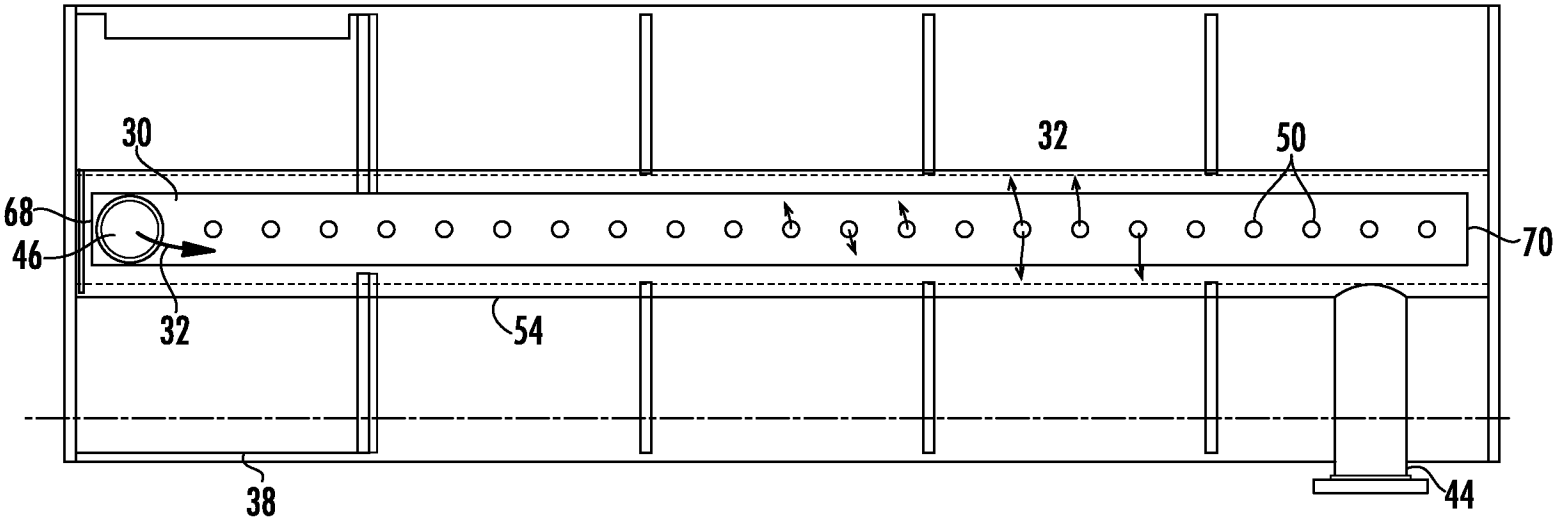
FIG. 5 is another cross-sectional view of an embodiment of a falling film evaporator.

Referring now to FIG. 5, the liquid refrigerant 32 enters the sparge channel 48 at a first sparge channel end 68 and flows toward a second sparge channel end 70. Openings 50 are arranged on an upper portion 52 of the sparge channel 48 allow flow of the liquid refrigerant 32 into the distributor chamber 30 and through the distribution sheet 54 forming a falling film over the evaporator tubes 28. Referring again to FIG. 4, remnants of the liquid and vapor refrigerant mixture 24 after separating the liquid refrigerant 32 therefrom comprises vapor refrigerant 36, which in the present application is defined as pure vapor refrigerant or vapor refrigerant with a volume of liquid refrigerant entrained therein. In some embodiments, the separator 42 has an efficiency of between 75% and about 99% in separation of the liquid refrigerant 32 from the vapor refrigerant 36. The vapor refrigerant 36 is routed from the separator 42 through vent stack 60 downwardly to a stack outlet 72 in proximity to the refrigerant pool 62. The stack outlet 72 is positioned within about 6 inches of a top level 74 of the refrigerant pool 62. In this embodiment, the vent stack 60 is positioned at the second end 66 of the separator 42.

Positioning the separator 42 inside of the evaporator housing 26 and closely coupling the separator 42 with the distributor 30 eliminates a need for large, expensive drain piping as well as eliminating the necessity of having the separator certified as an ASME VIII pressure vessel. Routing the vapor refrigerant 36 through the vent stacks 60 into the refrigerant pool 62 allows for higher tolerance of liquid entrainment in the vapor refrigerant 36 leaving the separator 42, as compared to systems where the vapor refrigerant is routed from the separator directly to the compressor. In some embodiments, the portion of liquid entrainment in the vapor refrigerant 36 is up to about 15-20%. As such, the separator 42 size can be reduced by 30-50% compared to a typical system, without affecting a size of the evaporator 12.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A heating, ventilation and air conditioning (HVAC) system comprising:
- a compressor flowing a flow of refrigerant therethrough;
- a falling film evaporator in flow communication with the compressor including:
  - a plurality of evaporator tubes through which a volume of thermal energy transfer medium is flowed;
  - a separator to separate a flow of liquid refrigerant from a vapor and liquid refrigerant mixture;
  - a distributor to distribute the flow of liquid refrigerant over the plurality of evaporator tubes; and
  - one or more vents stacks extending from a separator outlet at the separator downwardly toward a refrigerant pool of the evaporator to direct a flow of vapor refrigerant downwardly from the separator to a vent stack outlet in proximity with the refrigerant pool of the evaporator, the vent stack outlet located vertically below the separator outlet.

2. The HVAC system of claim 1, wherein the plurality of evaporator tubes, the separator, the distributor and the one or more vent stacks are disposed in an evaporator housing.

3. The HVAC system of claim 1, wherein the flow of liquid refrigerant flows from the separator into the distributor through a drain disposed in a shared wall of the separator and the distributor.

4. The HVAC system of claim 1, wherein the one or more vent stacks are arranged symmetrically with respect to a refrigerant inlet of the separator.

5. The HVAC system of claim 1, wherein the one or more vent stacks are two vent stacks.

6. The HVAC system of claim 1, wherein the separator includes one or more mechanical eliminators through which the flow of vapor refrigerant is directed before entering the one or more vent stacks.

7. The HVAC system of claim 6, wherein the mechanical eliminator is a perforated plate or a mesh screen.

8. The HVAC system of claim 1, wherein the separator is disposed above the distributor.

9. The HVAC system of claim 1, further comprising a suction nozzle at the evaporator to direct the flow of vapor refrigerant from the evaporator to the compressor.

10. A falling film evaporator comprising:
- a plurality of evaporator tubes through which a volume of thermal energy transfer medium is flowed;
- a separator to separate a flow of liquid refrigerant from a vapor and liquid refrigerant mixture;
- a distributor to distribute the flow of liquid refrigerant over the plurality of evaporator tubes; and
- one or more vents stacks extending from a separator outlet at the separator downwardly toward a refrigerant pool of the evaporator to direct a flow of vapor refrigerant downwardly from the separator to a vent stack outlet in proximity with the refrigerant pool of the evaporator, the vent stack outlet located vertically below the separator outlet.

11. The falling film evaporator of claim 10, wherein the plurality of evaporator tubes, the separator, the distributor and the one or more vent stacks are disposed in an evaporator housing.

12. The falling film evaporator of claim 10, wherein the flow of liquid refrigerant flows from the separator into the distributor through a drain disposed in a shared wall of the separator and the distributor.

13. The falling film evaporator of claim 10, wherein the one or more vent stacks are arranged symmetrically with respect to a refrigerant inlet of the separator.

14. The falling film evaporator of claim 10, wherein the one or more vent stacks are two vent stacks.

15. The falling film evaporator of claim 10, wherein the separator includes one or more mechanical eliminators through which the flow of vapor refrigerant is directed before entering the one or more vent stacks.

16. The falling film evaporator of claim 15, wherein the mechanical eliminator is a perforated plate or a mesh screen.

17. The falling film evaporator of claim 10, wherein the separator is disposed above the distributor.

18. The falling film evaporator of claim 10, further comprising a suction nozzle at the evaporator to direct the flow of vapor refrigerant from the evaporator.

* * * * *